United States Patent [19]

Rudnick

[11] Patent Number: 4,493,762

[45] Date of Patent: Jan. 15, 1985

[54] METHOD FOR REDUCING THE NITROGEN CONTENT OF SHALE OIL WITH SPENT OIL SHALE AND SULFURIC ACID

[75] Inventor: Leslie R. Rudnick, Trenton, N.J.

[73] Assignee: Mobil Oil Corporation, New York, N.Y.

[21] Appl. No.: 490,905

[22] Filed: May 2, 1983

[51] Int. Cl.[3] ..... C10B 53/06; C10G 1/00

[52] U.S. Cl. ..... 208/11 R; 208/254 R

[58] Field of Search ..... 208/254 R, 11 R, 266, 208/273

[56] References Cited

U.S. PATENT DOCUMENTS

| | | | |
|---|---|---|---|
| Re. 31,363 | 8/1983 | Stover | 208/254 R |
| 2,166,503 | 7/1939 | Milmore et al. | 208/273 |
| 2,518,353 | 8/1950 | McKinnis | 208/254 R |
| 2,999,807 | 9/1961 | Buningh et al. | 208/254 R |
| 3,719,587 | 3/1973 | Karchmer et al. | 208/254 R X |
| 4,117,886 | 10/1978 | Honaker | 208/11 A X |
| 4,125,457 | 11/1978 | Brennan et al. | 208/254 R |
| 4,132,639 | 1/1979 | Katz et al. | 208/266 X |
| 4,137,154 | 1/1979 | Audeh | 208/254 R |
| 4,140,181 | 2/1979 | Ridley et al. | 208/11 R X |
| 4,159,940 | 7/1979 | Smith | 208/254 R |
| 4,209,385 | 6/1980 | Stover | 208/254 R |
| 4,312,740 | 1/1982 | Chiaramonte | 208/11 R |
| 4,392,948 | 7/1983 | Debande | 208/254 R |

*Primary Examiner*—Delbert E. Gantz
*Assistant Examiner*—Glenn A. Caldarola
*Attorney, Agent, or Firm*—Alexander J. McKillop; Michael G. Gilman; Charles A. Malone

[57] ABSTRACT

A method is disclosed for reducing the nitrogen content of oil shale by removing therefrom nitrogen-containing compounds. The nitrogen content of shale oil is reduced by agitating the shale oil with designated amounts of acidified spent oil shale. Acidification is obtained by contacting spent oil shale with sulfuric acid produced by oxidizing hydrogen sulfide emanating from the oil shale retorting process. Agitation of the acidified oil shale with nitrogen-containing oil shale can be either a batch or continuous process. The method also provides for recycling acidified spent shale back into the process for further reduction of the oil shale nitrogen content.

24 Claims, 1 Drawing Figure

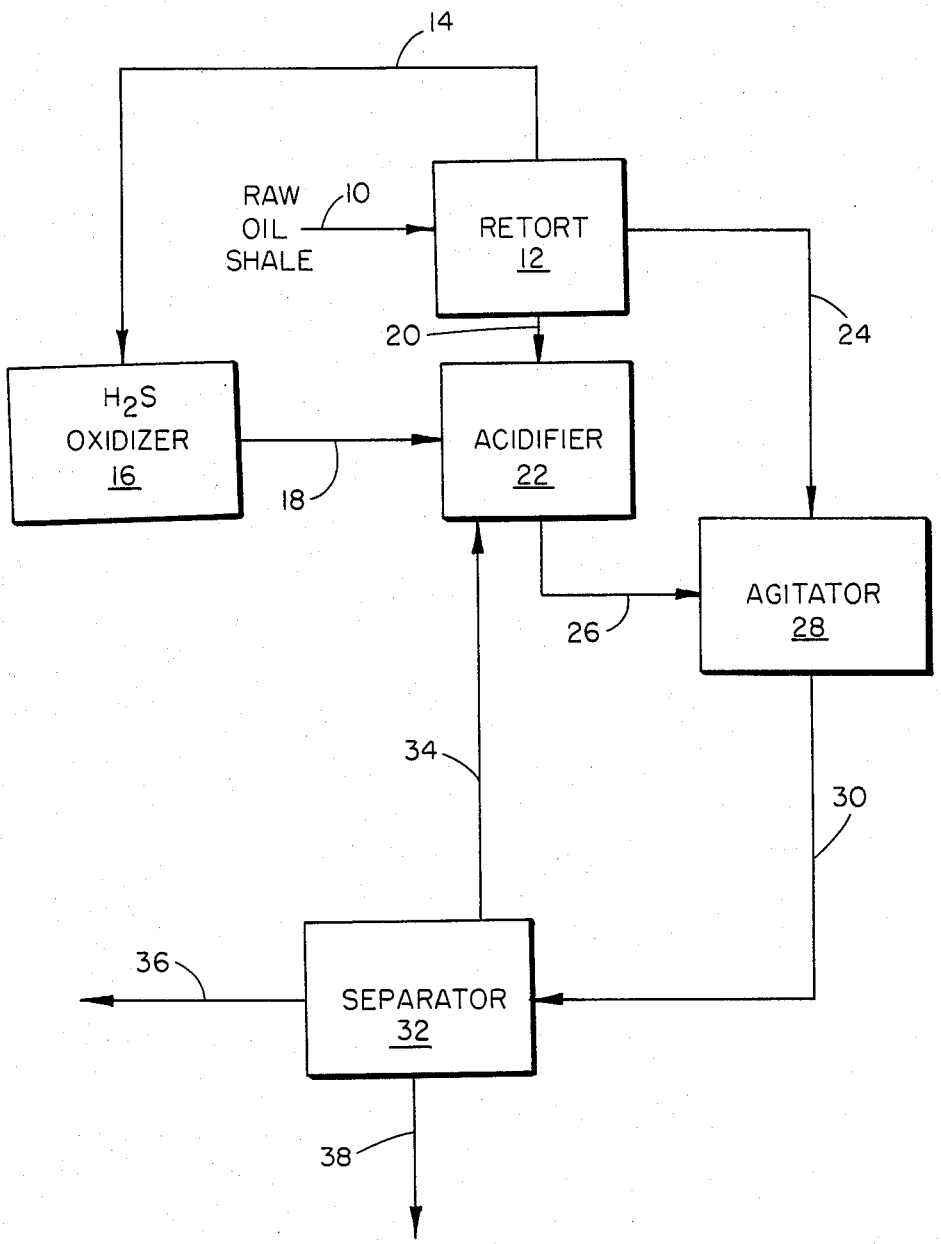
14
RAW
OIL
SHALE
10
RETORT
12
20
24
$H_2S$
OXIDIZER
16
18
ACIDIFIER
22
AGITATOR
28
26
34
30
36
SEPARATOR
32
38

METHOD FOR REDUCING THE NITROGEN CONTENT OF SHALE OIL WITH SPENT OIL SHALE AND SULFURIC ACID

BACKGROUND OF THE INVENTION

The method herein relates to reducing the total nitrogen content of shale oil by extracting nitrogen-containing compounds from the shale oil with a mineral acid-treated spent oil shale.

More particularly, this application relates to a method for reducing the nitrogen content of shale oil produced in either an above ground or an in situ shale retort.

The term "oil shale" as used in the industry is, in fact, a misnomer; it is neither shale nor does it contain oil. It is a sedimentary formation comprising marlstone deposits with layers containing an organic polymer called "kerogen" which, upon heating, decomposes to produce liquid and gaseous products. The formation containing kerogen is called "oil shale" herein and the liquid product produced upon decomposition of kerogen is called "shale oil".

Kerogen is considered to have been formed by the deposition of plant and animal remains in marine and nonmarine environments. Its formation is unique in nature. Alteration of this deposited material during subsequent geological periods produced a wide variety of organic materials. Source material and condtions of deposition were major factors influencing the type of final product formed.

Kerogen samples, found in various parts of the world, have nearly the same elemental composition. However, kerogen can consist of many different compounds having differing chemical structures. Some compounds found in kerogen have the structures of proteins while some have structures of terpenoids, and others have structures of asphalts and bitumens.

Shale oils produced from oil shale are generally high molecular weight, viscous organic liquids, of predominantly hydrocarbonaceous oxygen, nitrogen and sulfur containing organic compounds. The shale oils are of varying linear, branched cyclic aromatic hydrocarbon and substituted hydrocarbon content with high pour points, moderate sulfur content and relatively high nitrogen content. As the composition of shale oil depends upon the composition of the kerogen within the oil shale formation, the composition of the shale oil can vary from one geographic location to another. The shale oil produced from an oil shale formation can vary also between strata within the oil shale formation. The nitrogen content of shale oil can also vary dependent upon the geographical location of the oil shale deposit from which the shale oil is produced. Such a variance in nitrogen content in different geographical locations can be attributed to differences in the environment during the time of the deposition of the organisms which, upon lithification, became oil shale. Such a variance can also be attributed to the different types of organisms in the separate geographical locations which were deposited to form the organic substance in the oil shale and any organisms within the formed deposited layer which acted upon such deposited material to provide the kerogen within the oil shale formation.

The nitrogen content in shale oil is attributable to basic nitrogen-containing compounds and nonbasic nitrogen-containing compounds. The relative percentages of the basic and nonbasic nitrogen compounds comprising the total nitrogen content of a shale oil can also vary depending upon the particular shale oil.

The nitrogen content of shale oil is generally up to about two percent by weight. The average nitrogen content of shale oil recovered by in situ retorting of oil shale from the Piceance Creek Basin of Western Colorado is on the order of about 1.4 percent by weight.

The presence of nitrogen in shale oil presents many problems in that the nitrogen can interfere with the transportation and use of the shale oil. Deleterious effects brought about by the presence of nitrogen in shale oil are decreased catalyst life in dehydrogenation, reforming, hydrocracking and catalytic cracking reactions, decreased chemical stability of products, and decreased color stability of products. Another problem with the presence of nitrogen in shale oil is that it is undesirable to transport nitrogen-containing shale oil through pipelines which are also used for transporting petroleum products of possible pollution of such products with residual nitrogen-containing shale oil in the pipeline. Generally such petroleum products contain a very low nitrogen content. The relatively high nitrogen content in the shale oil can pollute the pipelines making them undesirable and uneconomical for transporting such low nitrogen-containing petroleum products. In addition, high nitrogen content in shale oil can cause clogging of pipelines due to self-polymerization brought about by the reactivity of the nitrogen-containing compounds in shale oil. Some corrosion can occur thus damaging a pipeline used to transport shale oil.

Product stability is a problem that is common to many products derived from shale oil with the major exception of the asphalt cut and those products that have undergone extensive hydrotreating. Such instability, including photosensitivity, is believed to be resultant, primarily from the presence of nitrogen-containing compounds.

It is, therefore, desirable to reduce the nitrogen content of shale oil to increase the utility, transportability, and stability of the shale oil and the products derived from such shale oil.

Due to the undesirable nature of nitrogen in organic fluid streams, such as fluid streams produced in the recovery and refining of petroleum, coal and oil shale, many processes have been developed to reduce the nitrogen content to an acceptable level. The level of acceptability for the nitrogen content is generally based upon the use of the particular stream.

In U.S. Pat. No. 3,719,587 to Karchmer et al. a process is disclosed for removing basic nitrogen-containing compounds from coal naphtha. The basic nitrogen compounds are removed by washing the naphtha with water or with a dilute aqueous solution of a strong acid. The dilute acid solutions are disclosed as from 0 to 10 weight percent of the acid such as sulfuric acid, hydrochloric acid, phosphoric acid and acetic acid.

U.S. Pat. No. 2,848,375 to Gatsis discloses a process for removing basic nitrogen compounds from organic substances by washing with a weak acid in combination with a polyalcohol. The weak acid used is boric acid in combination with a polyhydroxy organic compound which has hydroxyl groups on adjacent carbons.

U.S. Pat. No. 2,741,578 to McKinnis teaches that mineral oils can be treated to recover the nitrogen bases by extracting the mineral oils with a selective solvent for the nitrogen bases. The selective solvents are organic hydroxy compounds. Organic hydroxy compounds which can be used are the compounds which have a pH greater than 6.5.

U.S. Pat. No. 2,035,583 to Bailey discloses a process for the separation and recovery of nitrogen bases from mineral oils. In the process, the mineral oil is extracted with a solvent for the nitrogen bases. Acceptable solvents are liquid sulfur dioxide, furfural, aniline, nitrobenzene and isobutyl alcohol. However, due to the solubility of desirable mineral oils, such as aromatics and olefins, the process also includes extracting the resultant extract with dilute aqueous acids to recover the nitrogen bases from the first extract. The nitrogen bases are then recovered from the aqueous solution by adding an inorganic base to precipitate the nitrogen bases.

U.S. Pat. No. 2,035,102 to Stratford et al. discloses a process for improving the color and viscosity of petroleum oils. In the process an oil is extracted with a selective solvent in combination with an acid. The selective solvent can be phenol, nitrobenzene, furfural or liquid sulfur dioxide. The acid is preferably an inorganic acid but can also be an organic acid such as picric, acetic, oxalic, citric and benzene sulfonic acids.

U.S. Pat. No. 2,541,458 to Berg discloses a process for recovery of nitrogen bases from hydrocarbon fractions. In the process the fraction is extracted with a volatile acid or nonvolatile acid salt in combination with a mutual solvent for the acid and the hydrocarbon fraction. The mutual solvents include low boiling alcohols and ketones. The extraction is conducted in the presence of water to avoid loss of the volatile acids.

U.S. Pat. No. 2,309,324 to McAllister et al discloses a method for removing nitrogen bases from water-insoluble organic solvents, mineral oils and hydrocarbon fractions. In the process the mineral oil is extracted with an aqueous, weak acid solution. The weak acids are classified as acids having dissociation constants below $10^{-3}$. The aqueous acid solutions are prepared by dissolving from 15 to 90 weight percent of an acid in water. Upon extraction of the oil, two phases are formed. The aqueous phase contains the acid and absorbed nitrogen bases. The other phase consists of the organic substance from which at least a portion of the nitrogen bases has been removed.

U.S. Pat. No. 4,209,385 to Stover discloses a method for reducing the nitrogen content of shale oil with a selective solvent comprising an organic acid and a mineral acid. The organic acid was selected from the group consisting of organic acids, and substituted organic acids, particularly acetic, formic and trichloroacetic acids and mixtures thereof, the mineral acid was selected from the group consisting of hydrochloric acid, nitric acid, sulfuric acid, sulfurous acid, phosphoric acid and mixtures thereof.

None of the above methods disclose a method which utilizes hydrogen sulfide and spent oil shale, undesired by products of shale oil retorting, to remove nitrogen compounds from shale oil.

SUMMARY OF THE INVENTION

The present invention is directed to a method for the refining of shale oil wherein the nitrogen content of the shale oil is reduced by extracting nitrogen-containing compounds from the shale oil with acidified spent shale.

This method discloses retorting oil shale under oil shale retorting conditions and producing spent shale, a hydrogen sulfide containing gas, and a nitrogen containing shale oil. The hydrogen sulfide is extracted from the gas emanating from the retort and is oxidized to produce sulfuric acid. After removing the retorted spent shale from the retort, it is contacted with the produced sulfuric acid. Acidified oil shale is then agitated with nitrogen-containing shale oil. This agitation causes a reduction in the nitrogen content of the shale oil. Subsequently, the agitated oil shale is separated from the acidified spent shale.

BRIEF DESCRIPTION OF THE DRAWING

The drawing is a schematic representation of one embodiment of the invention.

DETAILED DESCRIPTION OF THE INVENTION

This invention relates to the refining of shale oil and more particularly to reduction of the nitrogen content of shale oil.

Although the method disclosed is not specifically directed to in situ retorting of oil shale, the method can be modified to reduce the nitrogen-containing content of the derived shale oil. Methods for which the process will work are numerous. Many of these methods for shale oil production are described in *Synthetic Fuels Data Handbook*, compiled by Dr. Thomas A. Hendrickson, and published by Cameron Engineers, Inc., Denver, Colo. For example, other processes for retorting oil shale include those known as the TOSCO, Paraho Direct, Paraho Indirect, N-T-U, and Bureau of Mines, Rock Springs, processes.

The TOSCO retorting process is described on pages 75 and 76 of the *Synthetic Fuels Data Handbook* and the U.S. patents mentioned therein, including U.S. Pat. No. 3,025,223. Generally speaking, this process involves preheating minus ½ inch oil shale to about 500° F. in a fluidized bed. Pyrolysis is completed in a rotating drum heated by ceramic balls which are separately heated in a ball-heating furnace.

The Paraho process is described at pages 62, 63, 84 and 85 of the *Synthetic Fuels Data Handbook* and the U.S. patents referred to therein. The Paraho process employs a vertical kiln through which ground oil shale moves downwardly as gas moves upwardly. Combustion air can be admitted into the bed of oil shale particles for direct heating of oil shale by combustion within the bed. This process is referred to as Paraho Direct. the kiln can also be arranged so that recycled gas can be heated externally, then injected into the bed of oil shale for indirect heating of the oil shale. Such a process is referred to as Paraho Indirect.

In one embodiment of this invention crushed oil shale is fed via line (10) into a surface retort (12) under oil shale retorting conditions which are known to those skilled in the art. During the retorting process hydrocarbon products are produced and are subsequently converted into liquid product or crude shale oil, which exits the retort (12) via line (24) where it enters the agitator (28). Hydrogen sulfide gases, collected by means known to those skilled in the art, exit the retort (12) through line (14), and are oxidized by standard industry procedures to sulfuric acid. The sulfuric acid is concentrated to the desired strength, which is generally from about 4 wt. % to about 95 wt. % sulfuric acid, most preferably 50 wt. % sulfuric acid.

This sulfuric acid is then led into an acidifier (22) by line (18) where it contacts the spent retorted shale after emerging from the retort (12) through conduit (20). The spent shale is cooled to a temperature of from about 30°

C. to about 200° C., most preferably about 75° C. and contacted with the sulfuric acid. Contact with the sulfuric acid continues for about 15 minutes, after which time the spent shale is suitably acidified. The acidified oil shale is then fed via conduit (26) into the agitator (28) where it contacts the shale oil exiting the retort via line (24). Temperatures in the agitation (28) are maintained at about 25° C. to about 100° C., most preferably about 75° C.

To obtain a satisfactory extracting of the nitrogen-bearing components, the shale oil is contacted with acidified oil shale for a period of about 5 minutes to about 180 minutes, most preferably about 15 minutes. The ratio of shale oil to acidified spent shale varies from about 10 to about 0.50 parts by weight of shale oil to one part by weight of acidified spent shale. The preferred ratio is from about 4 to about 1 parts by weight of shale oil to about one part by weight of acidified spent shale. In one embodiment, the flow rates and agitation speed can be predetermined so that the desired extracting and subsequent nitrogen reduction can be obtained in a continuous operation. In another embodiment, at least three separate agitators can be utilized and the shale oil can be contacted with each successively. In yet another embodiment, one agitator can be utilized and the shale oil passed therethrough three successive times.

Once the desired reduction in nitrogen-bearing content has been obtained, the shale oil is removed from the agitator via conduit (30) and transferred into a separator (32) in one embodiment of this invention. In another embodiment of this invention, as preferred, both the acidified oil shale and shale oil are removed from the agitator (28) and fed into the separator (32) via conduit (30). In the separator (32), the shale oil is separated from the acidified shale and sent to storage by line (36). Spent acidified shale is removed from the separator (32) via conduit (38).

In yet another embodiment of this invention spent acidified shale can be removed from the separator (32) and acidized with sulfuric acid in acidifier (22). This acidified shale can then be recycled into the agitator (28) for further contact with shale oil from line (24).

The invention is further illustrated by the following example, which is not intended to be limiting.

EXAMPLE

Two identical samples of Paraho shale oil containing 1.84 wt. % nitrogen were utilized in the test procedure. The nitrogen content of the samples was determined by the Kjeldahl method which is well known to those skilled in the art. Both samples were treated with equal volumes of identical reformate to reduce their viscosity. Sample number 1 was not treated with acidified oil shale. Sample number 2 was treated with acidified oil shale which had been contacted with sulfuric acid of a concentration of about 50 wt. %. During the 15-minute contact period the temperature of the spent oil shale was about 75° C. One part by weight of the acidified oil shale was mixed with four parts by weight of the Paraho shale oil in sample number 2. The sample was then agitated for about 15 minutes. After separation, samples 1 and 2 were analyzed by the Kjeldahl method. Upon analysis, it was determined that the nitrogen content of sample number 2 had been reduced to 1.68 wt. % nitrogen.

Reasonable variations and modifications are possible within the scope of this disclosure without departing from the spirit and scope of this invention.

What is claimed is:

1. A method of reducing the nitrogen content of shale oil comprising:

(a) retorting oil shale under oil shale retorting conditions and producing spent shale, hydrogen sulfide containing gas, and a nitrogen containing shale oil therefrom;

(b) extracting the hydrogen sulfide from the gas resulting from the retorting of the oil shale and oxidizing the hydrogen sulfide to sulfuric acid;

(c) removing and acidifying the spent retorted shale with the sulfuric acid resultant from the retort's hydrogen sulfide;

(d) agitating the shale oil and acidified spent shale together for about 5 to about 180 minutes which acidified spent shale extracts and reduce the nitrogen content of the shale oil; and (e) separating the agitated shale oil from the acidified oil shale.

2. A method as recited in claim 1 where in step (b) the sulfuric acid is of a concentration of from about 4 wt. % to about 95 wt. %.

3. A method as recited in claim 1 wherein in step (b) the sulfuric acid is of a concentration of from about 40 wt. % to about 60 wt. %.

4. A method as recited in claim 1 where in step (b) the sulfuric acid is of a concentration of from about 45 wt. % to about 55 wt. %.

5. A method as recited in claim 1 where in step (c) the temperature of the spent shale is from about 30° C. to about 200° C. when contacted with the sulfuric acid.

6. A method as recited in claim 1 where in step (c) the temperature of the spent shale is from about 70° C. to about 80° C. when contacted with the sulfuric acid.

7. A method as recited in claim 1 where in step (c) the temperature of the spent shale is about 75° C.

8. A method as recited in claim 1 where in step (c) the spent shale is contacted with sulfuric acid for about 15 minutes.

9. A method as recited in claim 1 where in step (d) the ratio of shale oil to acidified spent shale is from about 10 to about 0.50 parts by weight of shale oil to one part by weight of acidified spent shale.

10. A method as recited in claim 1 where in step (d) the ratio of shale oil to acidified spent shale is from about 6 to about 1 parts by weight of shale oil to one part by weight of acidified spent shale.

11. A method as recited in claim 1 where in step (d) the ratio of shale oil to acidified spent shale is from about 4 to about 1 parts by weight of shale oil to one part by weight of acidified spent shale.

12. A method of reducing the nitrogen content of shale oil comprising:

(a) retorting oil shale under oil shale retorting conditions and producing spent shale, hydrogen sulfide containing gas, and a nitrogen containing shale oil therefrom;

(b) extracting the hydrogen sulfide from the gas resulting from the retorting of the oil shale and oxidizing the hydrogen sulfide to sulfuric acid;

(c) removing and acidifying the spent retorted shale with the sulfuric acid resultant from the retort's hydrogen sulfide;

(d) agitating the shale oil and acidified spent shale together for about 5 to about 180 minutes which acidified spent shale extracts and reduces the nitrogen content of the shale oil;

(e) separating the agitated shale oil from the acidified oil shale;

(f) recovering the resultant shale oil and acidified oil shale; and (g) recycling the recovered spent acidified oil shale for further extraction of nitrogen-containing compounds from shale oil containing nitrogen-containing compounds.

13. A method as recited in claim 12 wherein in step (d) the shale oil is agitated with the acidified spent shale at least three successive times in a batchwise manner to extract nitrogen-containing compounds from shale oil containing nitrogen-containing compounds.

14. A method as recited in claim 12 where in step (d) the acidified spent shale is continuously agitated with the shale oil forming a continuous extraction process.

15. A method as recited in claim 12 where in step (b) the sulfuric acid is of a concentration of from about 4 wt. % to about 95 wt. %.

16. A method as recited in claim 12 where in step (b) the sulfuric acid is of a concentration of from about 40 wt. % to about 60 wt. %.

17. A method as recited in claim 12 where in step (b) the sulfuric acid is of a concentration of about 50 wt. %.

18. A method as recited in claim 12 where in step (c) the temperature of the spent shale is from about 30° C. when contacted with the sulfuric acid.

19. A method as recited in claim 12 where in step (c) the temperature of the spent shale is from about 70° C. to about 80° C. when contacted with the sulfuric acid.

20. A method as recited in claim 12 where in step (c) the temperature of the spent shale is about 75° C.

21. A method as recited in claim 12 where in step (c) the spent oil shale is contacted with sulfuric acid for about 15 minutes.

22. A method as recited in claim 12 where in step (d) the ratio of shale oil to acidified spent shale is from about 10 to about 0.50 parts by weight of shale oil to one part by weight of acidified spent shale.

23. A method as recited in claim 12 where in step (d) the ratio of shale oil to acidified spent shale is from about 6 to about 1 parts by weight of shale oil to one part by weight of acidified spent shale.

24. A method as recited in claim 12 where in step (d) the ratio of shale oil to acidified spent shale is from about 4 to about 1 parts by weight of shale oil to one part by weight of acidified spent shale.

* * * * *